US007153254B2

(12) United States Patent
Cordes

(10) Patent No.: US 7,153,254 B2
(45) Date of Patent: Dec. 26, 2006

(54) PRESENTATION FOLDER WITH ATTACHABLE POCKETS AND METHOD OF MAKING SAME

(76) Inventor: Mark S. Cordes, 380 Stonetown Rd., Ringwood, NJ (US) 07456

( * ) Notice: Subject to any disclaimer, the term of this patent is extended or adjusted under 35 U.S.C. 154(b) by 0 days.

(21) Appl. No.: 11/148,882

(22) Filed: Jun. 9, 2005

(65) Prior Publication Data

US 2005/0242566 A1 Nov. 3, 2005

Related U.S. Application Data

(63) Continuation-in-part of application No. 10/803,226, filed on Mar. 18, 2004, now abandoned.

(60) Provisional application No. 60/506,416, filed on Sep. 29, 2003.

(51) Int. Cl.
*B31B 1/62* (2006.01)

(52) U.S. Cl. ..... 493/947; 493/210; 493/347

(58) Field of Classification Search ..... 493/210, 493/224, 228, 229, 231, 232, 374, 354, 355, 493/220, 221, 947, 379; 229/67.1, 72
See application file for complete search history.

(56) References Cited

U.S. PATENT DOCUMENTS 1,408,509 A * 3/1922 Housh ..... 281/15.1
1,774,215 A * 8/1930 Weinthrop ..... 229/67.1
3,070,279 A * 12/1962 Lutwack ..... 229/72
3,516,599 A * 6/1970 Buttery ..... 229/72
4,401,257 A * 8/1983 Benham ..... 229/72
4,629,349 A * 12/1986 Pitts ..... 402/74
4,636,179 A * 1/1987 Gentile et al. ..... 402/79
4,989,777 A * 2/1991 Miller ..... 229/67.1
5,025,978 A * 6/1991 Pacione ..... 229/67.1
5,141,485 A * 8/1992 Welt ..... 493/210
5,405,473 A * 4/1995 Kuhns ..... 156/226
5,439,436 A * 8/1995 Moll ..... 493/394
5,447,334 A * 9/1995 Hartsock ..... 281/45

* cited by examiner

*Primary Examiner*—Hemant M. Desai

(57) ABSTRACT

A method of making a presentation folder with attached pockets comprising forming the pockets from a cardboard or multi-ply sheet and attaching the formed pockets to a scored generally rectangular folder sheet of cardboard or multi-ply sheet wherein the scored fold divides the sheet folder in two halves. Each preformed pocket is attached to each of said folder sheet halves in alignment with the bottom and side of the sheet, with a slit or opening across the top of the pockets for insertion of documents and the like.

A kit is also provided which comprises the scored sheet folder and the preformed pockets for attachment to each side of the sheet folder in order to form the presentation folder.

2 Claims, 5 Drawing Sheets

PRESENTATION FOLDER WITH ATTACHABLE POCKETS AND METHOD OF MAKING SAME

RELATED APPLICATION

This application is continuation-in-part of application Ser. No. 10/803,226 filed Mar. 18, 2004 now abandoned which relates to and claims the benefit of the filing date of provisional application Ser. No. 60/506,416 filed Sep. 29, 2003 entitled "Do It Yourself Presentation Folders With Attachable Pockets".

FIELD OF THE INVENTION

The present invention relates generally to folders, and in particular to a presentation or pocket folder having attachable pockets for insertion of loose papers, fliers and brochures for use in various business establishments. The invention also relates to a method of making such presentation folder which because of its simplicity to assemble, it can be referred to as "Do It Yourself Presentation Folder With Attached Pockets" and can be provided as a kit comprising the components used to make such folder.

BACKGROUND OF THE INVENTION

File folders are staple articles usually found in stationery stores for use in offices and various business establishments. It is well known to provide folders with or without pockets, and several methods have been described in the prior art for making pocket folders. However, the known methods of making pocket folders are cumbersome and expensive particularly since they are made and used in large quantities. Several prior art type folders and their deficiencies are described in various patents. For example, U.S. Pat. No. 5,141,485 issued Aug. 25, 1992 to Ralph E. Welt describes a prior art folder with pockets referring to FIG. 1 thereof, made from a standard size piece of cardboard. As mentioned in said patent, the method described for making the folders are expensive and does not meet customers' demands. Various other patents are mentioned in the Welt patent, all of which describe different pocket folders and methods of their manufacture, but concludes that none of said patents disclose folders having separate file folder pockets which can be pre-formed conveniently and inexpensively and thereafter attached to a folder.

In order to overcome the expensive and cumbersome prior art methods of manufacturing folders with attached pockets, the Welt patent discloses an "inexpensive" method that involves making a pocket for application to a folder, and comprises die-cutting a sheet to form a plurality of sheets in a single die-cutting operation, forming in the sheet fold lines defining a pocket panel, a bottom tab for attachment along a bottom edge of the folder panel, and a side tab for attachment along a side edge of the folder panel; and applying to each of said tabs double coated pressure sensitive adhesive tape having a protective coating on one side thereof which is peelable therefrom for adhesive attachment to the folder panel. In the method of the Welt patent, the large panel folder is formed by single die-cutting a large folder sheet using the so-called "guillotine-cutting" process and thereafter folding the sheet along a fold line to form two generally rectangular folder panels each having a side edge parallel to the fold line, a top edge and a bottom edge. The pockets are then applied to the folder panel sheet as hereinbefore described.

While the Welt method is somewhat of an improvement over the prior art, it nevertheless does not offer the simplicity and inexpensive method described in this invention.

It is therefore an object of the present invention to provide a simple and inexpensive method of making pocket folders, also called presentation folders, which are simple to make and assemble by the consumer.

It is a further object of this invention to provide a method of making the presentation folder from previously formed pockets and folder sheet and attaching the pockets to the folder sheet.

It is also an object of this invention to provide a kit comprising a folder sheet and pocket sheets with instructions for the consumer to follow in making the presentation folder by attaching the pockets to the folder sheet.

It is an additional object of this invention to provide a kit comprising the different components used to make presentation folder with attached pockets.

The foregoing and other objects and features of the present invention will now be described in the ensuing detailed description of the invention taken in conjunction with the accompanying drawings which form part of this application.

SUMMARY OF THE INVENTION

The present invention provides a simple and inexpensive method of making presentation folders with attached pockets. The method comprises forming a fold-line in a generally rectangular sheet folder in order to divide the sheet folder into a left panel and a right panel. A left pocket-forming structure is made for attachment to the left panel and a right pocket-forming structure is formed for attachment to the right panel. The left pocket-forming structure is formed by using a generally rectangular sheet similar to the folder and having a middle scored line which divides the sheet into two halves, e.g., an upper half-sheet and a lower half-sheet. The lower half-sheet has a glue flap which can be folded inwardly and glued to the facing surface of said lower half-sheet. The outer surface of the upper half-sheet has one or more peelable adhesive strips, preferably two parallel spaced adhesive strips. These strips are peeled off and the folder sheet is rotated 180 degrees such that the adhesive strip or surface faces the left panel of said folder, and is gently pressed against the surface of the left panel such as to form the left pocket with a slit across the top for insertion of documents.

The right hand pocket is formed on the right panel of the presentation folder in the same manner as the left hand pocket.

The present invention also provides a kits having one or more preformed pockets and sheet folders which can be used to form the presentation folder as hereinbefore described.

BRIEF DESCRIPTION OF THE DRAWINGS

In the drawings like reference numerals are employed to designate like parts.

DETAILED DESCRIPTION OF THE DRAWINGS

Figure 1:
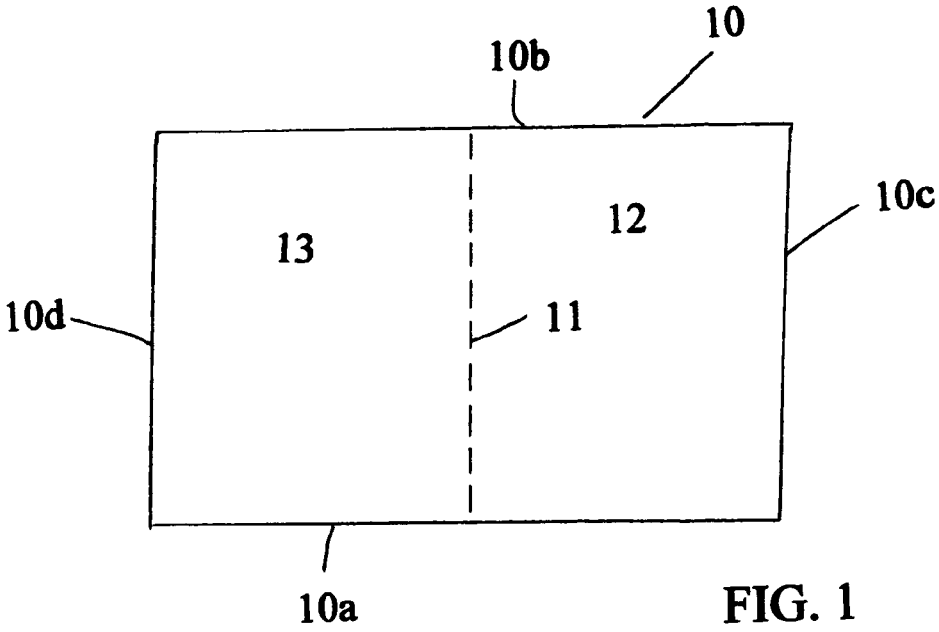
FIG. 1 is a plan view of a sheet used for forming the file folder.

Referring first to FIG. 1, there is shown at 10 a generally rectangular sheet made of cardboard or multi-ply paper suitable for making a file folder. The sheet 10 has a scored fold (line) 11 along which the sheet 10 can be folded to form the left and right half-sheets or panels 12 and 13, each of which constitutes half of the sheet 10. The sheet 10 is defined by the lower edge 10*a* and the upper edge 10*b* which are generally parallel to one another and perpendicular to the scored line 11, and the right and left side edges 10*c* and 10*d* which are also generally parallel with each other and with the scored line 11.

Figure 2:
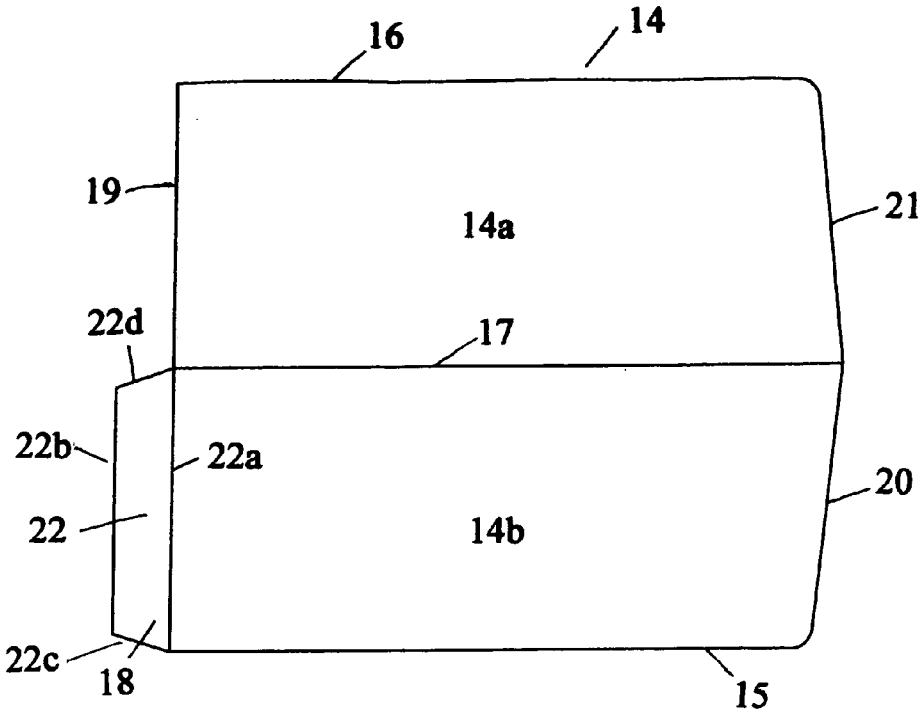
FIG. 2 is a plan view of a pocket sheet having a glue flap for forming a left-hand pocket.
Figure 3:
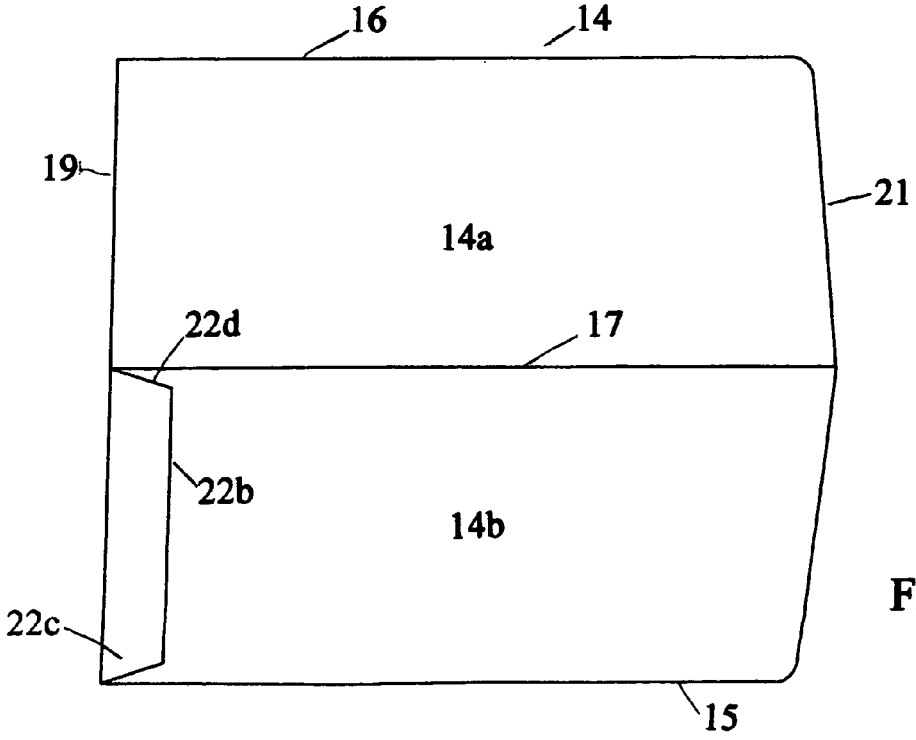
FIG. 3 is a view of the pocket sheet shown in FIG. 2 with the glue flap folded inwardly before attachment to the folder sheet.
Figure 4:
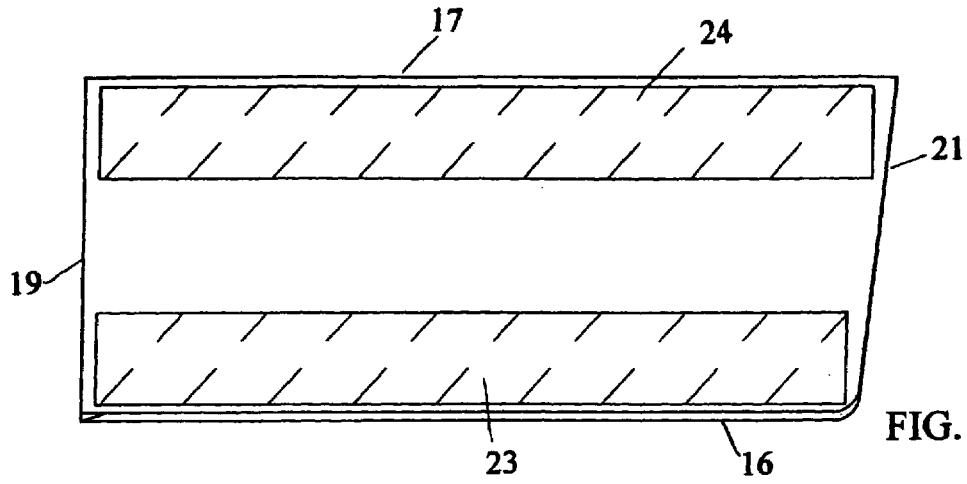
FIG. 4 is a plan view of the rear side of the left-hand pocket with double-sided peelable adhesive liner.

Referring to FIG. 2, there is shown the pocket forming sheet 14 which, as the sheet 10, is made of cardboard or multi-ply paper suitable for making a folder, and is defined by the longer side edges 15 and 16, a scored line 17 and shorter side edges 18, 19, 20 and 21. The shorter side edges 18 and 19 on left are generally perpendicular relative to the scored line 17 and the shorter side edges 20 and 21 on right are tapered relative to the scored fold 17 tapering toward the longer side edges 15 and 16 as shown in FIG. 2. The side edge 18 has a glue flap 22 which is defined by the longer generally parallel sides 22*a* and 22*b* and the shorter tapered sides 22*c* and 22*d*. The glue flap 22 is covered with a suitable glue or adhesive on it's outer surface and is adapted to be folded inwardly by folding the side edge 22*b* inwardly relative to the side edge 22*a* so that the glued outer surface is facing-up, (see FIG. 3). Next, the half-sheet 14*a* is folded over the scored line 17 onto the half-sheet 14*b* so that the inner surface of the short side edge 19 is glued with the glued outer surface of the glue flap 22 to form the left pocket-forming structure of the folder, with the longer side edge 16 coinciding across the length of the longer side edge 15 as shown in FIG. 4. As shown in this figure, two generally parallel strips of adhesive transfer tapes 23 and 24 are applied to the outer surface of the half-sheet 14*a*. These strips are readily peelable and are peeled away prior to affixing the pocket to the presentation folder as hereinafter described. If desired only one such peelable adhesive strip may be used.

Figure 5:
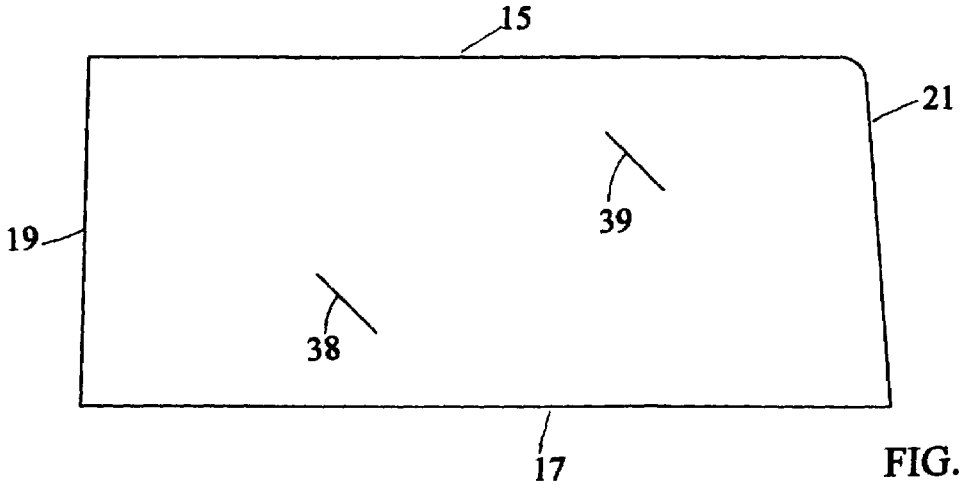
FIG. 5 is a plan view the front side of the left-hand pocket sheet showing two slits for insertion of business cards.
Figure 6:
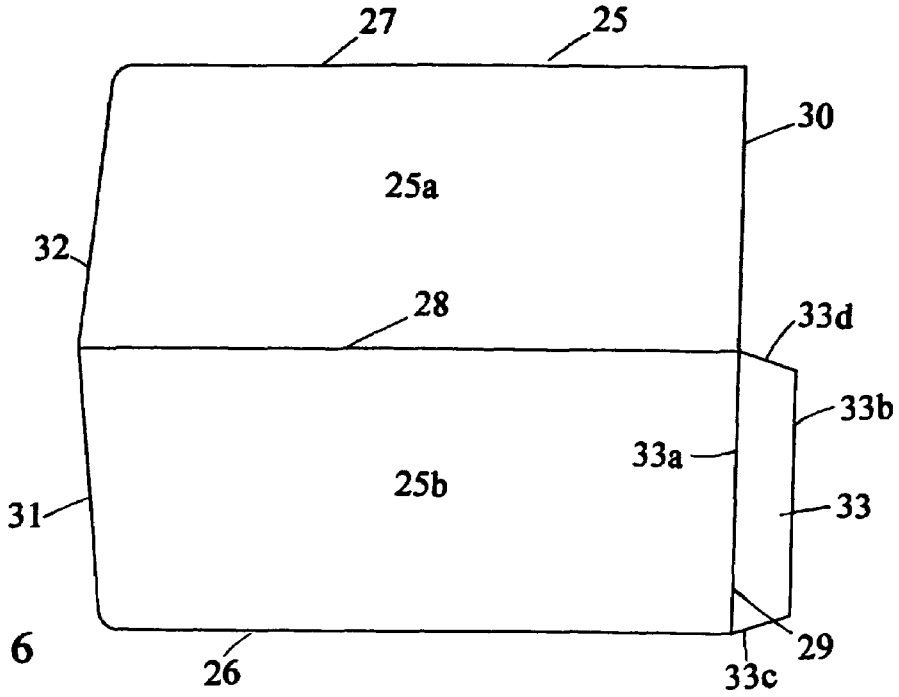
FIG. 6 is a plan view of the right-hand pocket sheet having a glue flap for forming a right-hand pocket.
Figure 7:
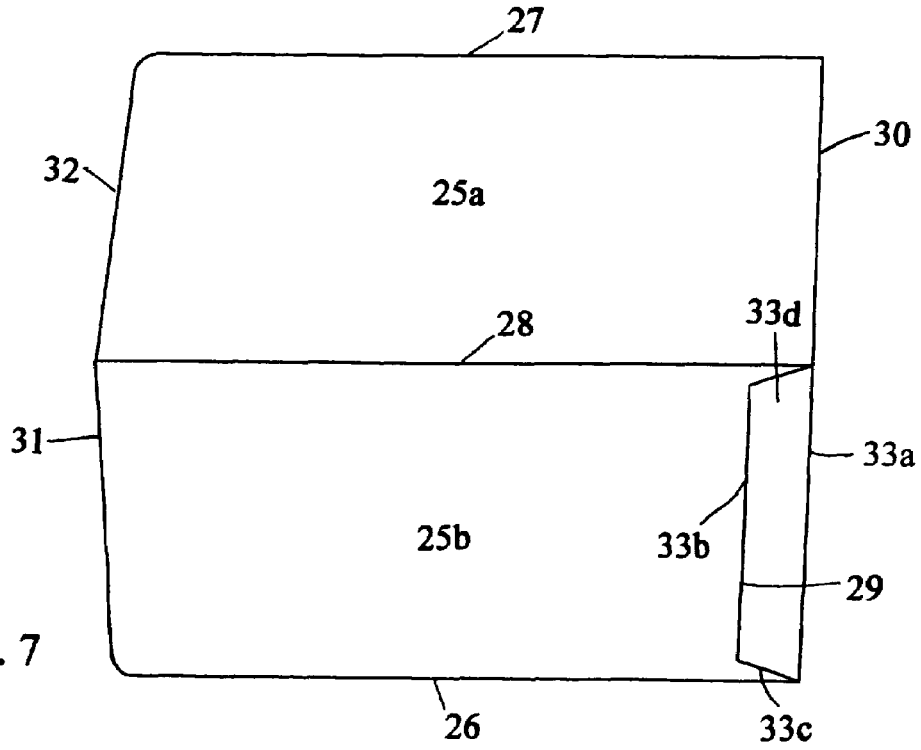
FIG. 7 is a view of the pocket sheet shown in FIG. 6 with the glue flap folded inwardly before attachment to the folder sheet.
Figure 8:
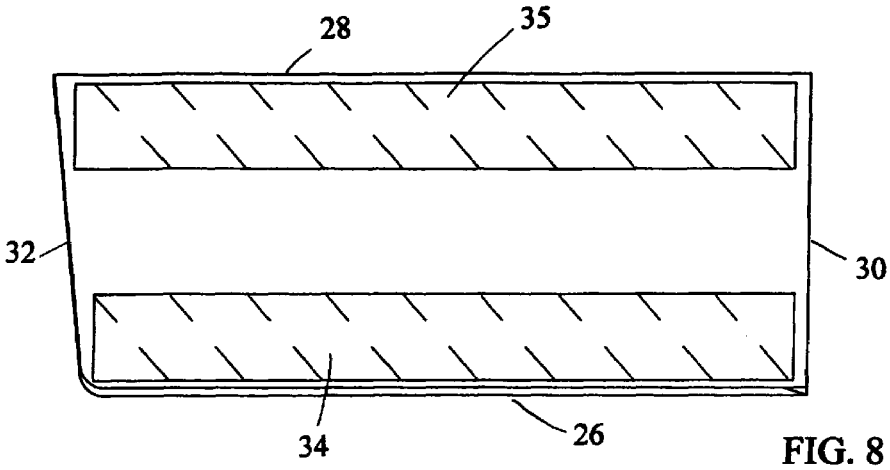
FIG. 8 is a plan view of the rear side of the right-hand pocket sheet with double peelable adhesive lines.
Figure 9:
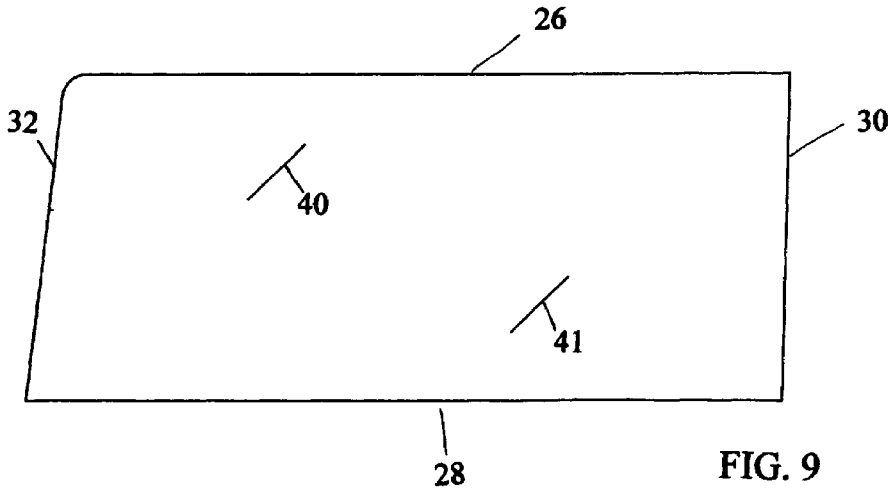
FIG. 9 is a plan view of the front side of the right-hand pocket sheet showing two slits for insertion of business cards.

FIGS. 6, 7, 8 and 9 are similar to FIGS. 3, 4, 5 and 6, respectively, but show the structural arrangements for forming the right hand pocket. In FIG. 6, the sheet 25 is also made of cardboard or multi-ply paper suitable for making a folder, and is defined by the longitudinal side edges 26 and 27, a scored line 28 and shorter side edges 29, 30, 31 and 32. The shorter side edges 29 and 30 on right are generally perpendicular relative to the scored line 28 and the short side edges 31 and 32 on left are tapered relative to the scored line 28, tapering toward the longer sides 26 and 27, respectively as shown in FIG. 6. The side edge 29 has a glue flap 33 which is defined by the longer generally parallel sides 33*a* and 33*b* and the shorter tapered side edges 33*c* and 33*d*. The glue flap 33 is covered with a suitable glue or adhesive on its outer surface adapted to be folded inwardly by folding the side edge 33*b* so that the glued outer surface is facing up as shown in FIG. 7. Next, the half-sheet 25*a* is folded over the half-sheet 25*b* along the scored line 28 so that the inner surface of the short side edge 30 is glued with the glued outer surface of glue flap 33 to form the right pocket-forming structure of the folder with the longer side edge 27 coinciding across the longer side edge 26 and the tapered side 32 coinciding across the tapered side 31 as shown in FIG. 8. As shown in this figure, two generally parallel strips of adhesive transfer tapes 34 and 35 are applied to the outer surface of the half-sheet 25*a*. These strips are readily peelable and are peeled off prior to affixing the pocket to the presentation folder as hereinafter described. If desired only one such peelable adhesive strip may be used.

Figure 10:
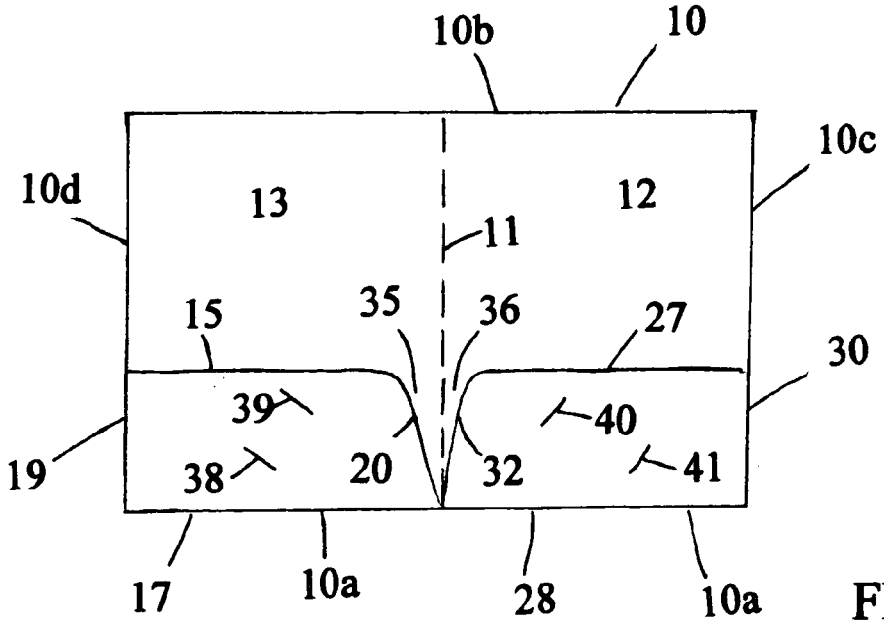
FIG. 10 is a plan view of the presentation folder of the present invention with the left pocket and the right pocket formed by the method of this invention.

Next, the pockets formed as hereinbefore described are applied to the folder sheet 10 to form the presentation folder. Referring to FIGS. 4, 5 and 10, in order to attach the left pocket to the left half-sheet 13, the pocket forming structure shown in FIG. 4 is rotated 180 degrees about the scored line 17, the adhesive strips 23 and 24 are peeled off by hand from the glue bearing surface and this surface is pressed gently against the lower left edge 10*a* of the half-sheet 13 to form the left hand pocket of the presentation folder having an opening 36 for insertion of documents. Each pocket also has a pair of slits as 38,39 for insertion of business cards. The right hand pocket is formed in the same manner. Thus, referring to FIGS. 8, 9 and 10, the pocket-forming structure shown in 8 is rotated 180 degrees about the scored line 28 so that the glue-bearing surface of the structure of Figure faces the half-sheet 12 of the sheet 10. The adhesive strips 34 and 35 are then peeled away leaving the glue strips exposed and glue strip bearing surface is pressed gently against the surface of the lower right edge 10*a* of the half-sheet 12 thereby forming the right hand pocket of the presentation folder having an opening 37 for insertion of documents. The slits 40 and 41 are provided for insertion of business cards.

The presentation folder hereinbefore described is shown as a rectangular folder with the pockets shown as identical in dimensions and configuration. This description, however is not intended to limit the configuration or dimensions of the folder. For example, the folder may be square-shaped and the pockets need not be identical in size but, as a practical matter, the configuration described herein is preferred. Thus, for the purpose of use in most offices and business establishments, the folder sheet itself may be 11 inches to 18 long and 8½ to 12 inches wide. Similarly, the pocket dimensions may vary and is usually from 5 to $8^{7/8}$ inches long and 3 to 4½ inches deep for receiving various sized documents. If it is intended to insert business cards or similar cards in the pockets, each pocket may be provided on its folded surface with one or more slits conveniently dimensioned for insertion of such cards.

The folder sheet and the pocket sheet are usually formed by known die-cutting methods using conventional die-cutting equipment, and these sheets are scored by conventional die-cutting methods known in the art as described, for example, in the aforementioned Welt patent.

In accordance with the present invention, consumers may be provided with a kit which contains, in non-assembled form, the components used for making the described presentation folders. It is thus contemplated that such a kit would comprise at least one, but preferably a plurality of separate folder sheets and pocket sheets accompanied by instructional documents for assembling the components which form the presentation folder. Also, the invention contemplates providing a kit with preformed pockets which can be used for attachment to a folder sheet as desired.

It can be appreciated from the foregoing description and drawings that the present invention is not limited to the embodiment herein described and that different variations are possible. Such variations are nevertheless obvious and are suggested from the present description.

The invention claimed is:

1. A method of making a presentation folder having attached pockets for insertion of documents, which method comprises:

(a) folding a generally rectangular sheet folder along a fold line, said fold line dividing said sheet into a left panel and a right panel, each of said panels having a side edge, a top edge and a bottom edge, (b) making a left pocket for attachment to said left panel, and a right pocket for attachment to said right panel, (c) said left pocket made by (i) providing a sheet having a middle scored line which divides said sheet into an upper half sheet, and lower half sheet; said upper half sheet having an outer surface comprising a peelable adhesive strip disposed thereon on and having a longer side edge parallel to the middle scored line, a left short side edge perpendicular to the middle scored line, a right tapered short side edge tapering towards the longer side edge; said lower half sheet being mirror image of the upper half and having a glue flap along the left short side edge which is perpendicular to the middle scored line, said glue flap covered with glue or adhesive on it's outer surface; folding said glue flap inwardly along the short side edge to make the glued outer surface face-up, (ii) folding said upper half-sheet over said lower half-sheet across said middle scored line such that the adhesive strip remains outside; gluing the inner side of the left short side edge of the upper half sheet to the glued outer surface of the glue flap to form the left pocket;

(iii) removing said adhesive strip and rotating said left pocket 180° about the longer side edge such that said adhesive strip face the left panel of said folded sheet, aligning the bottom folded edge of the left pocket with the bottom edge of the left panel, (iv) pressing said adhesive strip against said left panel to attach said left pocket, (d) said right pocket made by (i) providing a sheet having a middle scored line which divides said sheet into an upper half sheet, and lower half sheet; said upper half sheet having an outer surface comprising a peelable adhesive strip disposed thereon on and having a longer side edge parallel to the middle scored line, a right short side edge perpendicular to the middle scored line, a left tapered short side edge tapering towards the longer side edge; said lower half sheet being mirror image of the upper half and having a glue flap along the right short side edge which is perpendicular to the middle scored line, said glue flap covered with glue or adhesive on it's outer surface; folding said glue flap inwardly along the short side edge to make the glued outer surface face-up, (ii) folding said upper half-sheet over said lower half-sheet across said middle scored line such that the adhesive strip remains outside; gluing the inner side of the right short side edge of the upper half sheet to the glued outer surface of the glue flap to form the right pocket;

(iii) removing said adhesive strip and rotating said right pocket 180° about the longer side edge such that said adhesive strip face the right panel of said folded sheet, aligning the bottom folded edge of the right pocket with the bottom edge of the right panel, and (iv) pressing said adhesive strip against said right panel to attach said right pocket.

2. A method as in claim 1 wherein said outer surface of said upper half-sheet of said left pocket compromises a pair of parallel spaced apart peeled adhesive strips, and said upper half-sheet of said right pocket comprises a pair of parallel spaced apart peelable adhesive strips.

* * * * *